United States Patent [19]

Hanyu et al.

[11] 4,329,934

[45] May 18, 1982

[54] NEEDLE HOLDING DEVICE FOR SEWING MACHINES

[75] Inventors: Susumu Hanyu, Hachioji; Takao Oshima, Gyoda, both of Japan

[73] Assignee: Janome Sewing Machine Co., Ltd., Tokyo, Japan

[21] Appl. No.: 127,403

[22] Filed: Mar. 5, 1980

[30] Foreign Application Priority Data

Mar. 10, 1979 [JP] Japan ..... 54-31164

[51] Int. Cl.[3] ..... D05B 55/02

[52] U.S. Cl. ..... 112/226

[58] Field of Search ..... 112/226, 222, 227; 223/102

[56] References Cited

U.S. PATENT DOCUMENTS 2,973,733 3/1961 Johnson ..... 112/226

3,277,854 10/1966 Casas-Robert ..... 112/226

*Primary Examiner*—Peter P. Nerbun

*Attorney, Agent, or Firm*—Michael J. Striker

[57] ABSTRACT

A needle holding device for a sewing machine having a needle with a cylindrical shank having a flat edge surface extending along the shank includes a needle bar for supporting the needle, a needle holder mounted to the needle bar and a holding screw to fasten the needle to the needle bar. The needle bar is formed with a vertical groove defined by a horizontal wall and an inclined wall which are adjacent to each other to define a wedge-shaped space. The needle holder has a vertical circular hole having an inner periphery and a transverse hole extended into the vertical hole. When the needle holder is mounted to the needle bar the inner periphery of the vertical hole and the wedge-shaped space of the needle bar groove form a wedge-shaped chamber into which the shank of the needle is inserted. The holding screw fastens the needle upon insertion into the needle bar when the flat edge of the shank is positioned against the horizontal wall of the groove.

9 Claims, 20 Drawing Figures

NEEDLE HOLDING DEVICE FOR SEWING MACHINES

BACKGROUND OF THE INVENTION

The invention relates to a sewing machine, and more particularly relates to a needle holding device for a sewing machine having a needle with a cylindrical shank which is cut out to provide a flat surface.

SUMMARY OF THE INVENTION

It is an object of the invention to provide a needle holding device to fixedly hold a needle to the needle bar of the sewing machine and at the same time designed to prevent the needle from being attached to the needle bar in a wrong way.

It is a primary object of the invention to provide a needle holding device which is simple in structure and easily operated to fixedly hold a needle on the needle bar.

It is another object to provide a needle holding device which prevents the needle from being attached in a wrong way.

It is still another object of the invention to provide a needle holding device which is inexpensive.

For attaining this and other objects the needle holding device of the invention substantially comprises a needle bar formed with a vertically extended groove projecting from a certain distance from the lower end of the needle bar to receive the shank of the needle, the vertical groove is defined by at least one flat wall and at least one inclined wall providing together a wedge-shape space, a needle holder having a vertical circular hole providing an inner periphery thereof and a transverse threaded bore extended into the vertical circular hole, the needle holder is mounted to the lower end of the needle bar to provide a wedge-shape chamber defined by a part of the inner periphery of the vertical hole, the flat wall and the inclined wall of the vertical groove to receive the shank of the needle, and a needle holding screw arranged in threaded engagement with the transverse threaded bore and manually operated to be advanced toward the vertical hole to press the needle shank against the flat wall and the inclined wall. Generally, the shank of a needle has a predetermined diameter providing a periphery thereof and partly cut out to provide a flat face interrupting the periphery of the shank. The flat face of the shank is pressed against the flat wall of the groove, and a part of the periphery of the shank is pressed against the inclined wall of the groove. If the shank of the needle is attached to the needle bar in a wrong way, the device of the invention prevents the shank from being inserted into the vertical groove due to the wrong engaging relations between the shank of the needle and the related walls of the groove.

So far, various needle holding devices have been provided. For example, a needle holder, which is mounted to the lower end of the needle bar, is formed with a vertical circular hole of a diameter larger than that of the needle bar. The needle holder has a wedge-shape element with an inclined face, which projects into the vertical circular hole and is to be positioned in the vertical groove of the needle bar when the needle holder is mounted to the needle bar. Further, the needle holder has a screw provided on opposite side, which is operated to move to and from the wedge-shape element, so that the shank of the needle may be held between the wedge element and the bottom wall of the groove of the needle bar as the screw is advanced to the needle bar.

It is very difficult to make up such a conventional needle holder. In a sintering method, for example, the entire shape or configuration of the holder must be designed by sizing. Otherwise in the cut-out machining, the finished-up configuration must be obtained by broaching. Further in a precise casting, a finishing-up machining is required. In such machining precesses, the highly precise dimensicons are required. Eventually the production cost of such a needle holder becomes expensive.

The present invention has been provided to eliminate such defects and disadvantages of the prior art.

The other features and advantages of the invention will be apparent from the following explanation of the preferred embodiments in reference to the attached drawings.

DETAIL DESCRIPTION OF THE INVENTION

Figure 1:
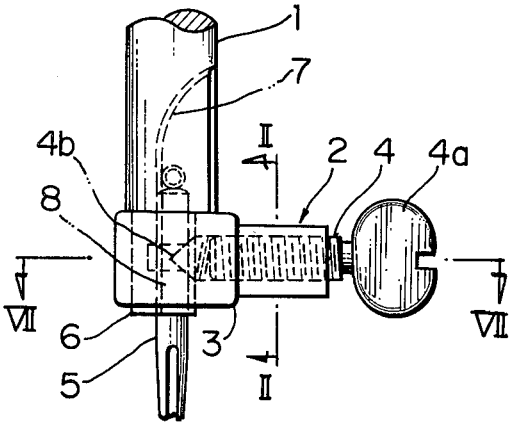
FIG. 1 is a front elevational view of the device of the invention.
Figure 2:
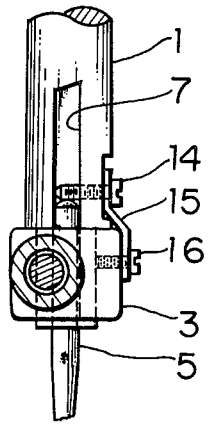
FIG. 2 is a side elevational view of the device taken along the line II—II in FIG. 1.
Figure 3:
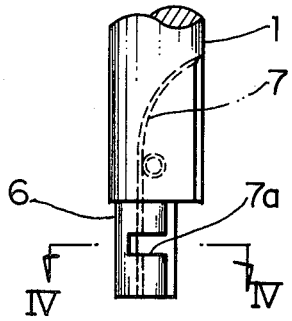
FIG. 3 is a front elevational view of a needle bar of the invention.

FIGS. 1–10 show a first embodiment of the invention. In reference to FIG. 1, a needle bar 1 of a sewing machine has a needle 5 attached thereto by means of a needle holder 2 which is substantially composed of a holder body 3 and a holding screw 4. The needle bar 1 has a lower cylindrical extension part 6 which is eccentric with respect to the vertical center axis of the needle bar 1 as shown in FIG. 3. The needle bar 1 has also a vertical groove 7 formed at the lower part thereof and extended through the lower extension part 6 as shown in FIG. 2. The vertical groove 7 is of a predetermined depth with respect to the center axis of the needle bar 1 in order to receive the upper shank of a needle 5.

Figure 4:
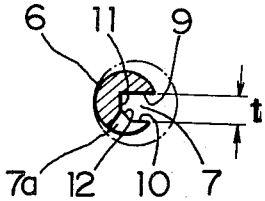
FIG. 4 is a plan view taken along the line IV—IV in FIG. 3.
Figure 7:
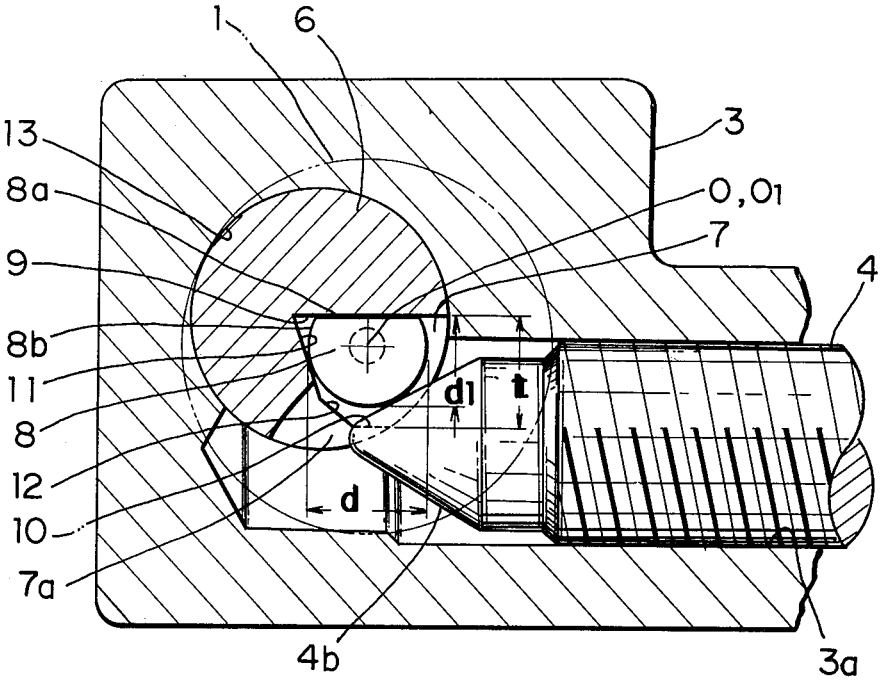
FIG. 7 is an enlarged plan view of the device in FIG. 1 taken along the line VII—VII, in which a thinner needle is attached to the needle bar.
Figure 8:
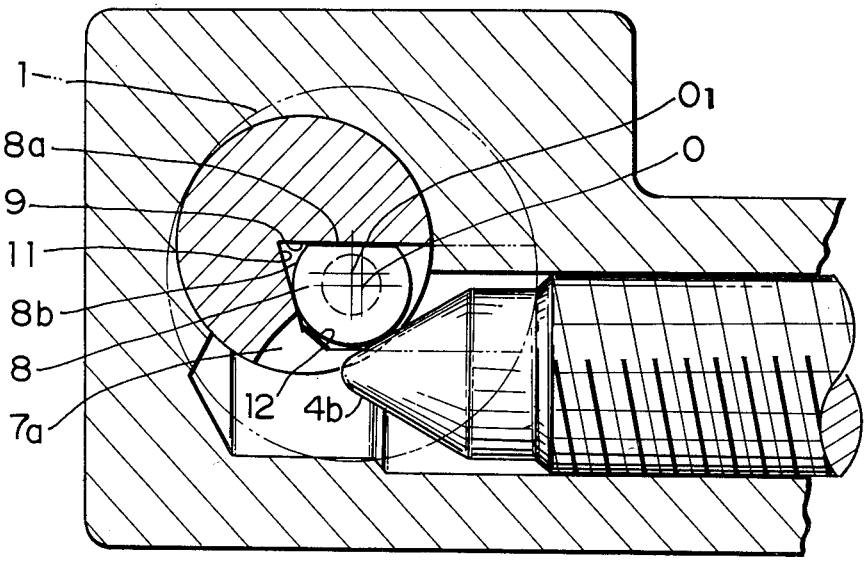
FIG. 8 is the same view of the device as in FIG. 7, in which, however, a thicker needle is attached to the needle bar.

As shown in FIGS. 4 and 7, the vertical groove 7 is of a width (t) which is smaller than the diameter (d) of the needle shank 8, but is broader than a distance ($d_1$), the distance from a flat face 8*a* to a point of the periphery 8*b* of the needle shank 8 which is remotest from the central point of the flat face 8*a*. The distance ($d_1$) or thickness of the needle shank 8 is different in dependence upon the needles to be used. In any events, the maximum distance or thickness is 1.62 mm. The vertical groove 7 is defined by a horizontal wall 9, an opposite wall 10 in parallel with the wall 9 and rightwardly inclined bottom walls 11, 12 as shown. Actually the walls 9, 11 of the groove 7 constitute the reference faces for determining a holding position of the needle shank 8. Thus, the vertical groove 7 is so formed as to position the center axis 0 of the needle 5 substantially in alignment with that $0_1$ of the needle bar 1 when the needle shank 8 is inserted into the groove 7 and is positioned by the holding screw 4 and the walls 9, 11 engaging the flat face 8*a* and the periphery 8*b* of the needle shank 8 respectively as seen in FIGS. 7 and 8 showing a thinner needle and a thicker needle respectively to be attached.

Figure 5:
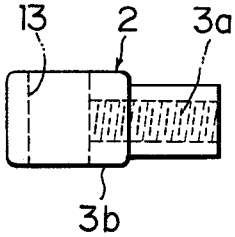
FIG. 5 is a front elevational view of a needle holder of the invention.
Figure 6:
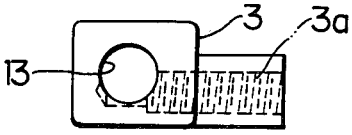
FIG. 6 is a plan view of the needle holder in FIG. 5.

As shown in FIGS. 1, 5 and 6, the needle holder body 3 is formed with a vertical circular hole 13 (though it may be oval) and is also formed with a transverse threaded bore 3*a* for guiding the needle holding screw 4 with a knob 4*a*. The transverse threaded bore 3*a* is, as shown, extended into the vertical hole 13 of the needle holder body 3 on one side spaced from the vertical center axis of the hole 13. The needle holding screw 4 has a tapered part 4*b* provided at the inner end thereof. The needle holder 2 is mounted to the lower extension part 6 of the needle bar 1 by means of the vertical hole 13 of the needle holder as shown in FIGS. 1 and 2, since the hole 13 is of a diameter slightly larger than that of the cylindrical extension 6. The tapered end part 4*b* of the screw 4 is guided partly into the vertical groove 7 and partly into a lateral cutout 7*a* (FIG. 4) of the lower extension part of the needle bar as the needle holding screw 4 is threaded into the threaded hole 3*a* of the needle holder 2.

As shown in FIG. 2, the needle holder 2 is secured to the lower end of the needle bar 1 by means of a connecting element 15, which is at its lower end secured to the needle holder 2 by a screw 16 and is at the upper end secured to the needle bar 1 by another screw 14. The screw 14 is transversely extended into the vertical groove 7 so as to function as a stopper of the needle 5 as it is inserted into the vertical groove 7.

With the foregoing structure of the invention, the shank 8 of the needle 5 is inserted into the vertical groove 7 of the needle bar 1 until the upper end of the needle shank 8 is pressed against the stopper screw 14 in such a condition that the flat face 8*a* of the needle shank 8 is directed to the horizontal wall 9 of the groove 7. Then, if the needle holding screw 4 is rotated in one direction, the tapered end 4*b* of the screw 4 is threaded partly into the vertical groove 7 and partly into the lateral cutout 7*a* of the lower extension part 6 of the needle bar 1. The tapered end 4*b*, therefore, engages a part of the periphery 8*b* opposite to the flat face 8*a* of the needle shank 8 presses the needle shank 8 against the horizontal wall 9 and the rightwardly inclined bottom wall 11 of the groove 7, both providing a wedge-shape holding part. Thus the needle 5 is fixedly held on the needle bar 1.

Figure 9:
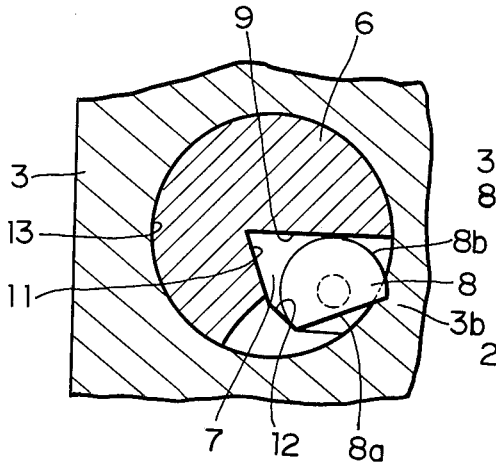
FIG. 9 is the same view of the device as in FIG. 7, in which, however, the needle is going to be attached to the needle bar in a wrong way.
Figure 10:
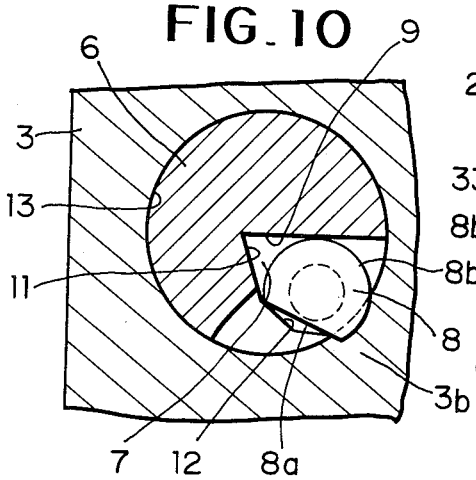
FIG. 10 is the same view of the device as in FIG. 8, in which, however, the needle is going to be attached to the needle bar in a wrong way.

FIGS. 9 and 10 show the conditions in which the machine operator is going to attach the needle 5 in wrong ways to the lower end 11 of the needle bar 1. In any events, the shank 8 of the needle 5 can not be inserted into the groove 7, because a part 3*b* of the holder body 3 prevents the needle shank 8 from being inserted into the groove 7 due to the wrong engaging relations between the needle shank 8 and the walls 9, 11 of the groove 7.

Thus the invention prevents a wrong attachment of the needle to the needle bar, and secures a correct attachment of the needle to the needle bar if the needle shank 8 is once inserted into the groove 7.

Figure 12:
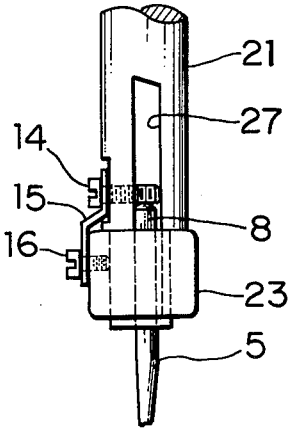
FIG. 12 is a side elevational view of the embodiment taken from the direction A in FIG. 11.
Figure 13:
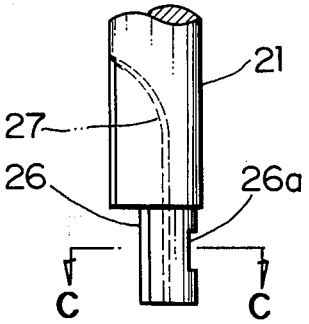
FIG. 13 is a front elevational view of a needle bar of the embodiment.
Figure 14:
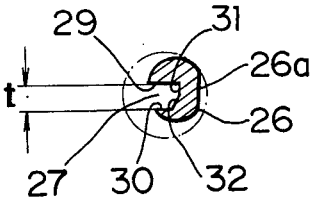
FIG. 14 is a plan view of the needle bar taken along the line C—C.

FIGS. 11–20 show another embodiment of the invention. In reference to FIG. 11, a needle bar 21 of a sewing machine has a needle 5 attached thereto by means of a needle holder 22 which is substantially composed of a holder body 23 and a holding screw 24. As shown in FIGS. 12 and 13 the needle bar 21 has a lower cylindrical extension part 26, and is formed with a vertical groove 27 extended through the lower extension part 26 which is eccentrically provided with respect to the vertical center axis of the needle bar 21. The vertical groove 27 is of a predetermined width and a depth with respect to the center axis of the needle bar to receive the shank 8 of the needle 5, and is provided on the opposite side of the needle bar 21 in comparison with the first embodiment. As shown in FIG. 14, the groove 27 is defined by a horizontal wall 29, an opposite wall 30 in parallel with the horizontal wall 29 and leftwardly inclined bottom walls 31, 32. The width (t) of the groove 27 is the same as that of the first embodiment.

Figure 17:
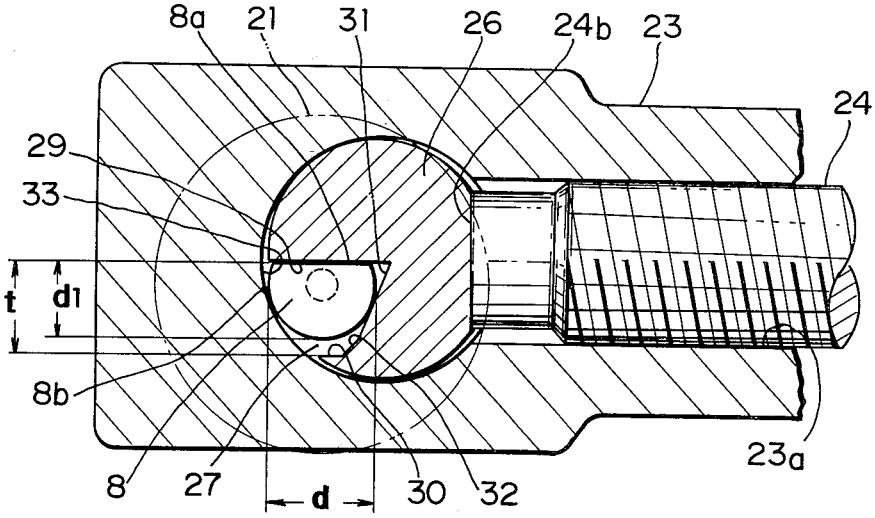
FIG. 17 is an enlarged plan view of the embodiment in FIG. 11 taken along the line B—B, in which a thinner needle is attached to the needle bar.
Figure 18:
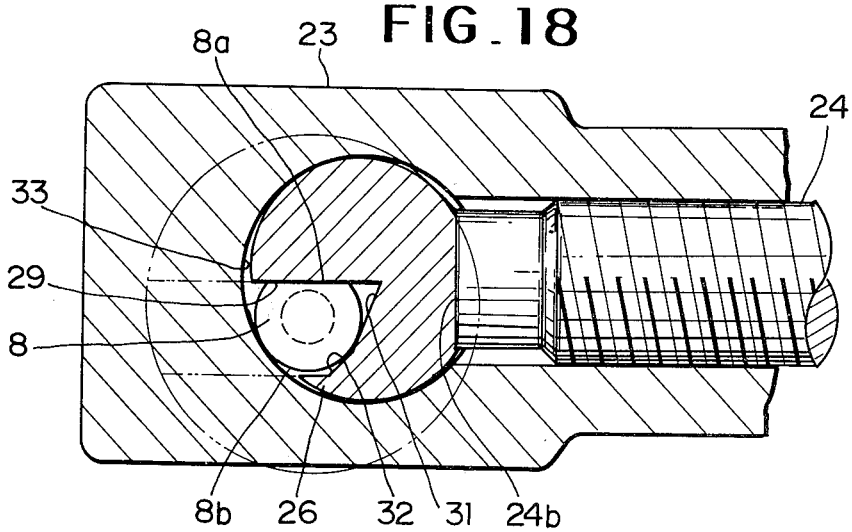
FIG. 18 is the same view of the embodiment in FIG. 17, in which, however, a thicker needle is attached to the needle bar.

As shown in FIGS. 17 and 18, the horizontal wall 29 and the inclined bottom wall 31 of the groove 27 constitute the reference faces for determining a holding position of the needle shank 8. Thus, the vertical groove 27 is so formed as to position the center axis of the needle shank 8 substantially in alignment with that of the needle bar 21 when the shank 8 of the needle 5 is inserted into the groove 27 and is positioned by the holding screw 24 and the walls 29, 31 engaging the flat face 8*a* and the periphery 8*b* of the needle shank 8 respectively. FIGS. 17 and 18 show a thinner needle and a thicker needle respectively to be attached. As shown, the vertical groove 27 is so formed as to position a part of the periphery 8*b* of the needle shank slightly out of the groove 27 beyond the periphery of the lower cylindrical extension part 26 when the shank 8 of the needle 5 is inserted into the groove 27.

Figure 15:
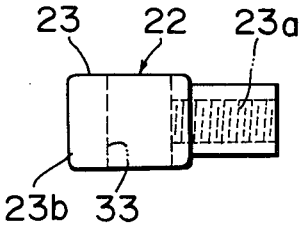
FIG. 15 is a front elevational view of a needle holder of the embodiment.
Figure 16:
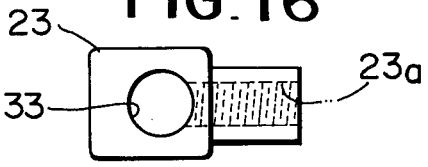
FIG. 16 is a plan view of the needle holder of the embodiment.

As shown in FIGS. 15 and 16, the holder body 23 of the needle holder 22 is formed with a vertical circular or oval hole 33, the diameter of which being slightly larger than that of the cylindrical lower extension part 26 of the needle bar 21. The holder body 23 is also formed with a transverse threaded bore 23*a* through which the needle holding screw 24 with a knob 24*a* is threaded into. The holder body 23 is mounted to the cylindrical lower extension 26 of the needle bar 21 by means of the hole 33 and is secured thereto by means of the connecting element 15, which is at the lower end secured to the holder body 23 by the screw 16 and is at the upper end secured to the needle bar 21 by the screw 14 which is transversely extended into the vertical groove 27 in the same manner as in the first embodiment.

As shown in FIGS. 17 and 18, the needle holding screw 4 has an inner flat end 24*b* which is to be pressed against a cutout flat face 26*a* of the lower extension part 26 of the needle bar 21, which is provided on the side opposite to the vertical groove 27 as shown in FIG. 13. The transverse threaded bore 23*a* is provided in such a manner that the center axis thereof intersects the vertical center axis of the hole 33 of the holder body 23.

Therefore, if the holding screw 24 is rotated in one direction after the shank 8 of the needle 5 is inserted into the vertical groove 27 as shown in FIGS. 17 and 18 until the upper end of the needle shank 8 is pressed against the stopper screw 14, the screw 24 is threaded into the threaded bore 23*a* and the inner flat end 24*b* is pressed against the flat face 26*a* of the lower extension 26 of the needle bar 21. As the screw 24 is further rotated, the holder body 23 is displaced in the rightward direction, and a part of the inner periphery of the vertical hole 33 of the holder body 23 presses against the needle shank 8 against the horizontal wall 29 and the inclined bottom wall 31, both providing a wedge-shape holding part. Thus the needle 5 is fixedly attached to the needle bar 21.

Figure 19:
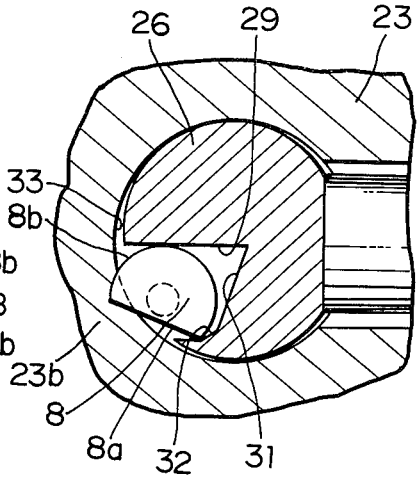
FIG. 19 is the same view of the embodiment as in FIG. 17, in which, however, the needle is going to the attached to the needle bar in a wrong way.
Figure 20:
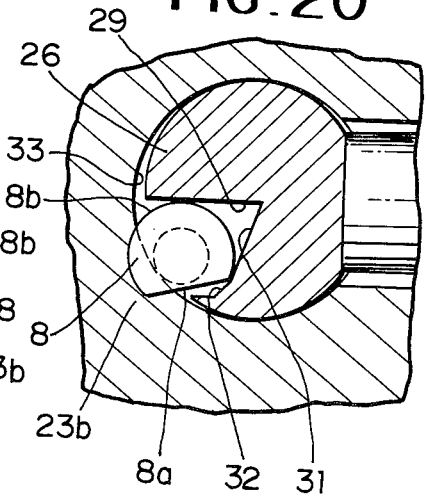
FIG. 20 is the same view of the embodiment as in FIG. 18, in which, however, the needle is going to be attached to the needle bar in a wrong way.
Figure 11:
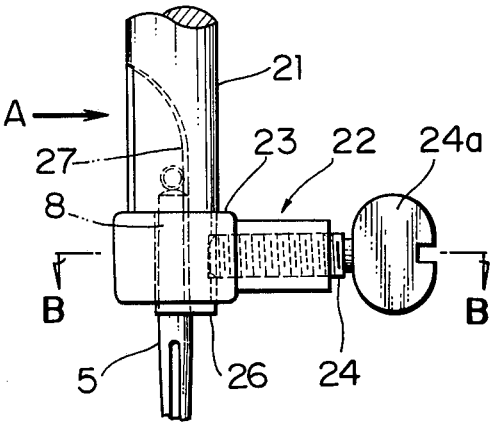
FIG. 11 is a front elevational view of another embodiment of the invention.

FIGS. 19 and 20 show the conditions in which the machine operator is going to attach the needle 5 in wrong ways to the lower end 26 of the needle bar 21. In any events, the shank 8 of the needle 5 can not be inserted into the groove 27, because a part 23*b* of the holder body 23 prevents the needle shank 8 from being inserted into the groove 27 due to the wrong engaging relations between the needle shank and the walls 29, 31 of the groove 27.

Thus the embodiment prevents a wrong attachment of the needle to the needle bar, and secures a correct attachment of the needle to the needle bar if the needle shank 8 is once inserted into the groove 27.

I claim:

1. A needle holding device for a sewing machine of the type having a needle with a shank of substantially semi-circular shape with a cut out edge to define a flat surface thereon, comprising a needle bar for supporting said needle, said needle bar being formed with a vertically extended groove projecting a predetermined distance from a lower end thereof, said vertically extended groove being defined by at least two opposite walls spaced from each other and extending in parallel with each other and by an angular wall connecting said opposite walls at one end thereof; needle holding means formed with a vertical circular hole providing an inner peripheral wall therein and a transverse hole extended into said vertical hole, said needle holding means being mounted to said needle bar so that in assembly said inner peripheral wall of said vertical hole partly forms a wall connecting said two opposite walls at the other end thereof, said walls defining the groove and an additional part of said inner peripheral wall of said needle holding means providing a chamber of substantially same shape and dimension as those of said semicircular shank; and manually operative means arranged to be inserted into said transverse hole and advanced toward said vertical hole to press and hold the shank of the needle when the flat surface of the inserted shank is positioned against one of said opposite walls of said groove.

2. The needle holding device of claim 1, wherein said transversal hole is a threaded bore and said manually operative means is a holding screw arranged in threaded arrangement with said bore upon insertion thereof.

3. The needle holding device of claim 2, wherein a second inclined wall is formed in said groove adjacent to said angular wall, said angular and said second inclined walls are extended between said opposite walls.

4. The needle holding device of claim 3, wherein said needle bar includes a lower projection of substantially cylindrical shape, said projection being of a diameter smaller than that of said needle bar, said groove of said needle bar is extended within said projection so that the shank of the needle upon insertion is projected into said groove beyond the length of said projection.

5. The needle holding device of claim 4, further comprising mounting means to fasten said needle hold means to said needle bar.

6. The needle holding device of claim 5, wherein said mounting means include at least two screws.

7. The needle holding device of claim 6, wherein one of said two screws is projected into an upper portion of said groove to thereby restrict a position of the shank of the needle in a vertical direction.

8. The needle holding device of claim 7, wherein said groove is formed on a side of said needle bar facing said holding screw includes a tapered end which engages the shank of the needle upon insertion into said chamber.

9. The needle holding device of claim 7, wherein said groove is spaced from a side of said needle bar facing said holding screw, said holding screw including a flat end portion and said side of said needle bar facing said holding screw has a cut out flat surface so that said end portion of said holding screw engages said flat surface of the needle bar upon insertion of the shank of the needle into said chamber.

* * * * *